US011851259B2

(12) United States Patent
Honda et al.

(10) Patent No.: US 11,851,259 B2
(45) Date of Patent: Dec. 26, 2023

(54) PACKAGING SYSTEM

(71) Applicants: Travis Honda, Henderson, NV (US); Robert Speerstra, Colbert, WA (US)

(72) Inventors: Travis Honda, Henderson, NV (US); Robert Speerstra, Colbert, WA (US)

( * ) Notice: Subject to any disclaimer, the term of this patent is extended or adjusted under 35 U.S.C. 154(b) by 29 days.

(21) Appl. No.: 17/556,369

(22) Filed: Dec. 20, 2021

(65) Prior Publication Data

US 2023/0192381 A1 Jun. 22, 2023

(51) Int. Cl.
*B65D 81/05* (2006.01)
*B65D 43/16* (2006.01)
*B65D 85/10* (2006.01)

(52) U.S. Cl.
CPC ..... *B65D 81/05* (2013.01); *B65D 43/162* (2013.01); *B65D 85/10* (2013.01)

(58) Field of Classification Search
CPC ..... B65D 81/05; B65D 85/12; B65D 85/10; B65D 81/07; B65D 25/101; B65D 25/10; B65D 21/0201; B65D 71/50; B65D 71/00; B65D 43/162; A24F 15/02; A24F 15/12; A24F 15/00
USPC ..... 206/276, 265, 583
See application file for complete search history.

(56) References Cited

U.S. PATENT DOCUMENTS 6,398,051 B1 * 6/2002 Brozell ..... B65D 51/26 206/828
6,921,370 B2 * 7/2005 Zhou ..... A61B 10/0096 600/562
7,413,083 B2 * 8/2008 Belfance ..... B65D 81/266 206/204
7,726,487 B2 * 6/2010 Ahmad ..... A61K 31/355 206/568
8,763,797 B2 * 7/2014 Guillon ..... B65D 81/07 206/204
10,941,970 B2 * 3/2021 Encinas ..... F25D 3/08
2010/0044252 A1 * 2/2010 Portier ..... B65D 51/30 206/204
2021/0000173 A1 * 1/2021 Alexander ..... A24F 15/12
2021/0070501 A1 * 3/2021 Filleul ..... B65D 50/00
2022/0061378 A1 * 3/2022 Van Den Berg ..... A24D 1/025

OTHER PUBLICATIONS https://www.airgas.com/product/Safety-Products/Hearing-Protection/Earplugs/p/RAD64051810.
https://www.alpinehearingprotection.com/earplugs/partyplug/.
https://earlabs.co/dbud/shop/products/dbud-volume-adjustable-earplugs/.
https://www.nonoise-earplugs.com.
https://www.honeywellstore.com/store/products/honeywell-hearing-protection-single-use-earplugs-r-01669.htm.
https://www.npr.org/sections/allsongs/2019/03/12/692852104/tiny-tech-tips-why-you-need-earplugs-at-concerts.
https://www.brickowl.com.catalog/lego-flexible-rubber-axle-connector-45590.

* cited by examiner

*Primary Examiner* — Steven A. Reynolds
(74) *Attorney, Agent, or Firm* — Aronberg, Goldgehn, Davis, & Garmisa

(57) ABSTRACT

The present apparatus and system relate to a structure for housing and containing products together and protecting products within a container from agitation and blunt force trauma. A resilient plug is adapted to fit within a container and contact a product housed within the container. When the container exhibits forces from movement, the plug dampens the impact of the movement by steadying the product within the container. Multiple containers may be mixed and matched and held together with a bundler that allows for easy insertion of the containers into the bundler but more difficult removal from the bundler.

11 Claims, 8 Drawing Sheets

PACKAGING SYSTEM

BACKGROUND

Traditionally, filled cones, such as cigarettes, pre-rolls, and other particulate filled cones have been sold in multi-unit packages. An example of a particulate filled cone is shown and described in U.S. Pat. No. 11,130,596, the entirety of which is incorporated herein for all purposes by this reference. Similar products, like cigars, have been sold in individual tubes. However, there is a problem with such packages in that they permit excessive movement of the products. While such movement does not tend to impact products like cigarettes and cigars, which are formed of intertwined leaves, such movement is problematic for many other products. Particularly, products that are formed of loose particulate, such as crumbled leaves, can be adversely affected by such movement. In the past, filled cones were often fully closed at the top, such as by forming twists in the paper of a cone that completely closed off the top of the cone. But even in those products, excessive movement within a closed package can adversely affect the filled cone by creating an environment where shock to the cone dampens or packs the particulate within the cone.

More recently, cones with ends that are folded in on themselves and held by plastic deformation within the cone have been created, such as the cones of U.S. Pat. No. 11,130,596. Some embodiments of those cones have an access hole within the center of a distal end of the cone such that the particulate matter of the cone is substantially, but not completely, covered by plastically deformed paper of the cone. It has been found that in such embodiments, movement of the cone within the container (or in some cases mere inversion of the container housing the cone) results in a portion of the particulate matter escaping from the cone through the access hole. That leads to waste of the particulate matter and a substandard product when the customer opens the package containing the product.

The present system addresses at least the foregoing issues. It creates a system for packaging filled cones and preventing excessive movement of the filled cones within packages. It also provides a system for collecting multiple individual packages into a larger group and linking the group into an easily transportable single package.

SUMMARY

The present packaging system employs a uniquely designed plug that mates with a container holding a prefilled cone to provide stability to the cone within the package. It also presents a system for combining multiple containers together into a single package. The combination of the packaging system described herein prevents damage to the filled cones and prevents particulate filling within the cones from escaping even when the packages experience changes in orientation and shock (for example as would occur when the package tumbles out of a person's hand and hits the ground). While some product embodiments may generally be described herein as being cones with a filling of crumbled plant matter, such as crumbled dried leaves, it should be understood that any loose particles that could fit within the cone could be used as a filling for the cone without departing from the general scope of the apparatus and system. For simplicity, all such loose particles will simply be referred to herein as "leaves" or "particulate," but the use of such terms herein in no way limits the apparatus to only packaging organic plant matter. It should be understood that while "paper" is a common substance to be used for cones, that term is used generically herein for any relatively thin, flexible, substrate and is not strictly limited to traditional paper. It should be understood that the term "cone" need not be a traditional cone with a point at one end, but may be of any generally cylindrical shape or shape having a greater length than width (or diameter, where the term "width" as it is used in describing the width of an object having a circular cross section is the diameter), though preferably the shape of a truncated traditional cone or frustum.

As an example, a suitable filled cone could be made according to the system and method described in U.S. Pat. No. 11,130,596. A cone with a filling may be oriented with respect to a folder sub-component. Folding fingers may precisely bend a portion of the cone and a folding tip compresses the bent portion of the cone to close it. Alternatively, an iris folding system may be utilized in place of the folding fingers to close on the distal portion of the cone and compress it against the folding tip. The folding tip may have an outer circumference that is configured to surround the distal end of a cone, particularly the distal rim of the distal end of a cone. It may also include a central portion, such as an axial pin. In some embodiments, the folding tip is adapted to apply one or more of vacuum pressure and positive air pressure to the cone. For example, suction may be applied by the folding tip circumferentially to the distal end of the cone, and air pressure may be injected into the interior of the cone through an axial pin of the folding tip. The folding fingers or iris release and the folding tip drives down onto the distal end of the paper cone to fold the distal rim and at least a portion of the distal end onto itself and into the interior cavity of the cone, thereby folding the distal end of the cone. The folded portion at least substantially (and may completely in some embodiments) cover the particulate within the cone. Some cones may be pierced to form an access hole in the distal, folded end. Some cones may have an access hole formed through the use of a folding tip with a pin that creates the access hole as part of the folding process.

The cones may then be further processed, such as by injecting a fluid. When a cone is complete, it may be placed within a container. Containers may be formed of a tube of various shapes and sizes, such as triangular, square, circular, or hexagonal cross-section tubes. The tube is longer than the cone, such that the cone fits within an interior cavity of the tube. The tube may be open at one end and closed at the other. A top may be secured onto the open end to form a closed package.

To prevent undesirable movement of the cone within the tube a plug is provided prior to closing the tube. As discussed in more detail herein, the plug may be a resilient material that engages the interior cavity of the tube to seal the interior cavity of the tube containing the cone from the outside environment. The plug may have a protuberance or shaft that extends into the interior of the cavity to contact the cone. It may have a stopper portion that contacts the distal end or mates with the access hole. It may also include a pull tab that extends away from the cone and in some embodiments out of the cavity so that the plug can be gripped and removed from the tube.

A bundling device may further be utilized to collect a plurality of the tubes together into a single package. The bundling device may include holes having cross-sectional shapes corresponding to the cross-sectional shapes of the tubes. In one embodiment the holes are slightly tapered along their length.

Further embodiments and structures of the present apparatus and system will be apparent to one of ordinary skill in the art in view of the description and drawings detailed below.

DETAILED DESCRIPTION OF EMBODIMENTS

Throughout the specification, wherever practicable, like structures will be identified by like reference numbers. Unless expressly stated otherwise, the term "or" means "either or both" such that "A or B" includes A alone, B alone, and both A and B together. "Approximately" as used herein means rounding to a scientifically significant figure.

Figure 1:
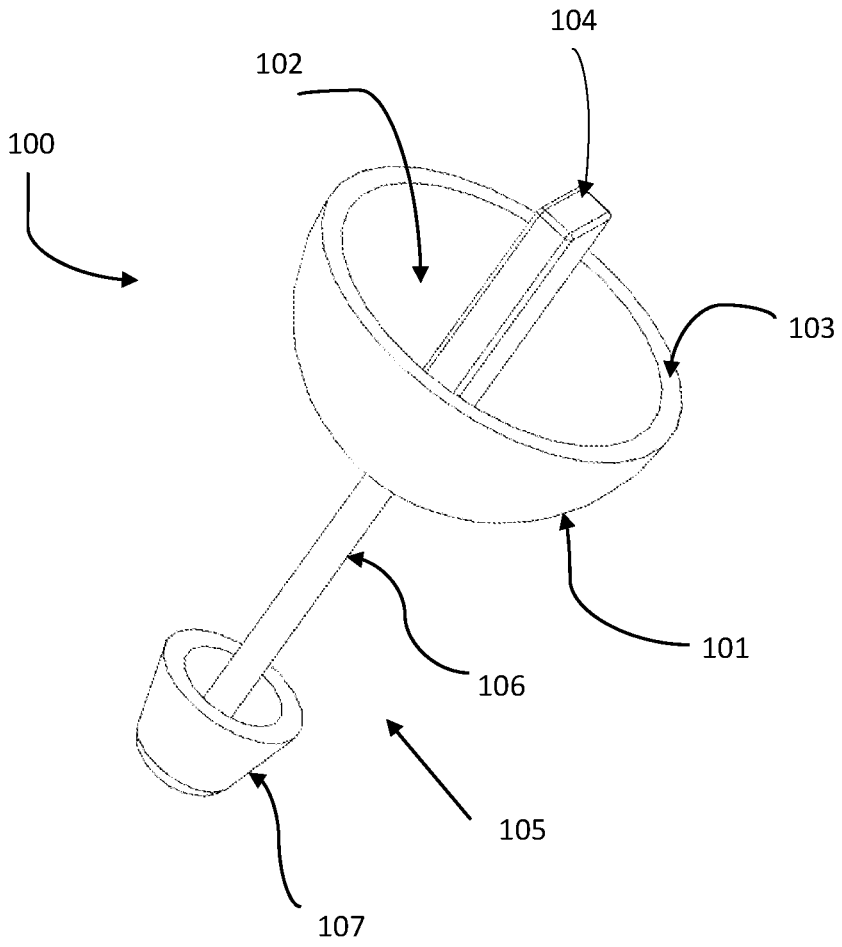
FIG. 1 is a perspective view of an embodiment of a plug exhibiting the new distinctive elements.

FIG. 1 generally depicts an embodiment of a plug 100. The plug includes a dome 101 that is formed of a pliable, resilient material. As used herein, the term dome is used as a general reference to a three-dimensional shape having a dome-like structure, though not necessary limited to hemispherical domes. While the dome of FIG. 1 is hemispherical, other shapes could be utilized depending on the shape of a corresponding container. For example, a plug having a pyramidal dome could be used with a container having a triangular or square shape. Examples of suitable resilient materials are silicone and rubber. The dome also need not be a perfect hemisphere, but could instead be elongated or more squat. Preferably, the resilient material is fluid (i.e. liquid and gas) impermeable. That allows the plug to form a fluid tight barrier between an interior cavity of a container and the outside environment. The entirety of the structure of the plug may be made of the same resilient material. For example, the entire plug may be formed of molded silicone.

In one embodiment, the dome 101 includes a hollow cavity 102. The hollow cavity is formed by a concave surface that is opposite the convex surface of the dome. The dome may be formed such that when the plug is inserted into a cavity of a corresponding container, the hollow, concave cavity is disposed outward, while the convex surface of the dome is disposed inward. Generally the dome 101 may be formed in the shape of a hollow half-sphere that terminates at rim 103. It was found that by forming the dome with a concavity, when the plug is pulled to remove it from the container cavity, the dome remains frictionally engaged with the sidewall of the cavity and does not substantially slide. Rather, the dome inverts and thereafter the plug disengages from the sidewall, releases, and is extricated from the cavity. For that reason, it was found that, when forming the present packaging system through utilizing a container having a circular opening, a plug having a hemispherical dome exhibited a more uniform seal between the container sidewall at the opening and the convex portion of the dome. Thus in some embodiments, the opening of the cavity (for example the top quarter of the container) may have a circular cross-section while the remaining portion of the container may have an alternative cross-sectional shape (such as a triangle).

The plug may include a tab 104. The tab 104 may extend from the concave surface. For the purpose of explanation, with respect to the orientation of the plug shown in FIG. 1, the concave surface forming cavity 102 will be referred to as the outer surface, while the convex surface forming the dome 101 will be referred to as the inner surface.

The tab 104 may extend along a central axis of the dome, the axis being perpendicular to the plane formed by the rim 103. In the embodiment of FIG. 1, the tab extends above rim 103. While the tab shown is rectangular, other shapes could be utilized. In one embodiment, approximately 20% to 50% of the total length of the tab 104 extends beyond rim 103. It was found that such a range allowed for the tab to be easily gripped but would not include excessive material that could otherwise impede closing of a top over the plug. Because the plug may be made of resilient material, a flat top can be pushed over the top of the plug and the tab can resiliently deform into the cavity 102. When the top is removed, the tab can spring back to position and protrude out of the dome.

The plug includes a protuberance, generally referenced by numeral 105. The protuberance is formed of a shaft 106 having a proximal end and a distal end. The proximal end is connected (directly or indirectly) to the dome. The proximal end may be connected by, for example, an adhesive, but it may also be connected by integrally forming the shaft with the dome, such as by molding the components together. The shaft of FIG. 1 is shown as a cylinder, however, other shapes, such as a square, rectangle or cone, could be used.

The shaft terminates at the distal end. The distal end may include a stopper 107. The stopper may provide a larger contact surface than the cross-sectional surface of the shaft. For example, the stopper may be in the shape of a cone or conical frustum or sphere. The taper of the frustum may extend out and away from the shaft as the frustum is viewed from the distal end to toward the proximal end.

Figure 2:
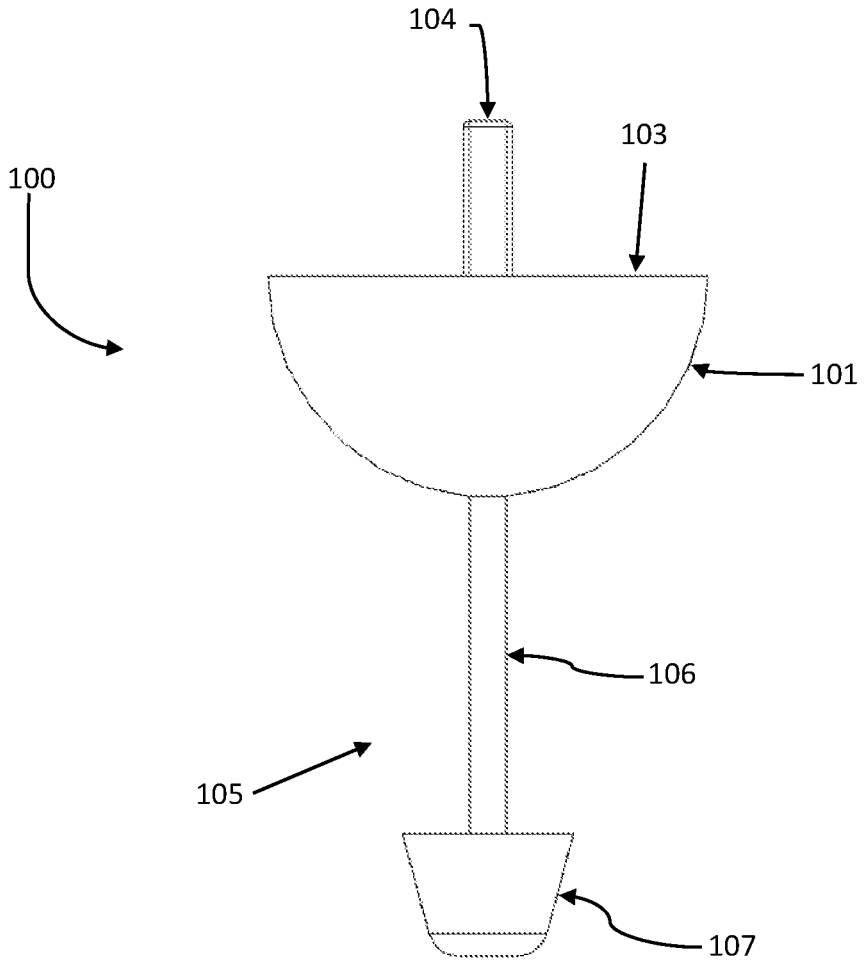
FIG. 2 is a plan view of the side of an embodiment of a plug exhibiting the new distinctive elements.
Figure 3:
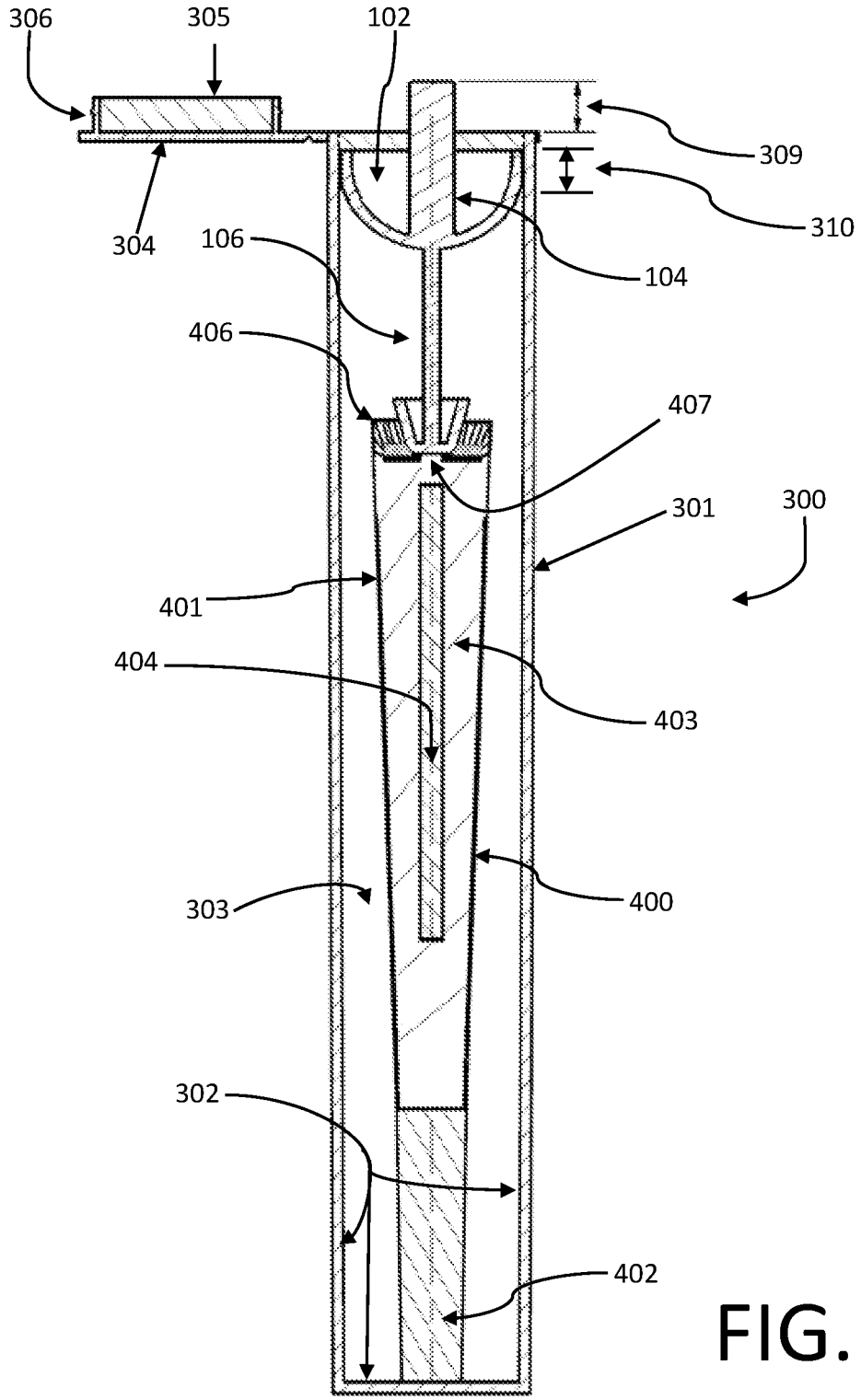
FIG. 3 is a cross-sectional view of an embodiment of a container housing a cone and utilizing a plug according to the new system.
Figure 4:
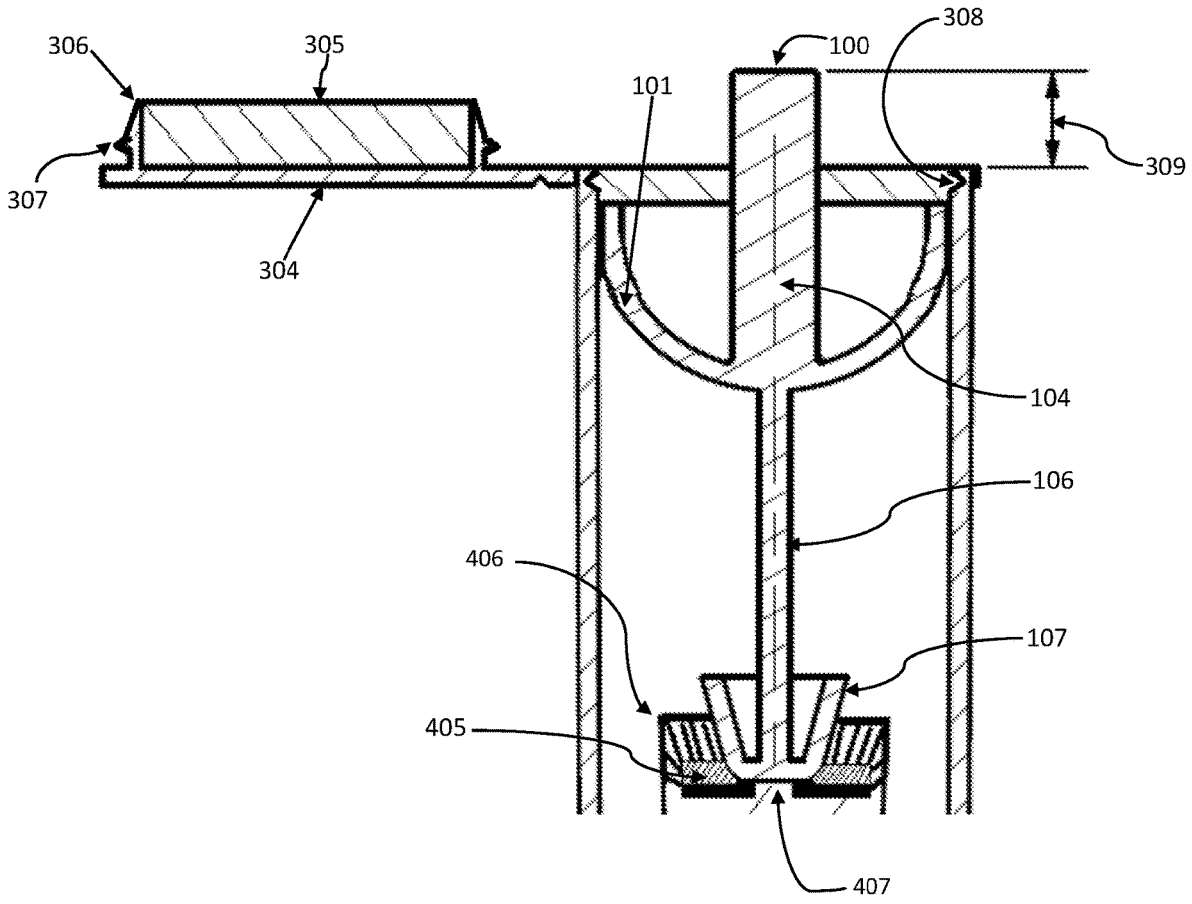
FIG. 4 is an enlarged view of the upper portion of an embodiment of a container housing a cone and utilizing a plug according to the new system.

The plug may snugly fit within a container and hold the contents of the container in place (or at least substantially minimize movement of the container contents). FIG. 3 is a cross-sectional view of one embodiment of the packaging system utilizing the plug of FIGS. 1-2 and a cylindrical container 300. While the embodiment of FIG. 3 is depicted as a uniform cylinder, it should be appreciated that the container need not be uniform about its length and that alternative shapes could be utilized. The container has an exterior surface 301 and an interior surface 302 that defines a cavity 303. The top of the container is open to allow for a product 400 to be placed within the cavity. The container may include a top or lid 304. The lid may be adapted to cover the opening of the container and securely close the container, such as by frictional engagement with the container. In the embodiment of FIGS. 3-4, for example, the lid 304 includes a collar 305 on the bottom that nests within the cavity of the container. The outer surface 306 of the collar may include a circumferential protuberance 307 that engages a circumferential detent 308 formed in the interior surface of the container. In one embodiment the exterior surface 306 of the collar is beveled or tapered such that when the top is closed, the tapered surface of the collar compresses the dome 101 against the interior surface of the container. That allows the top to enhance the seal between the plug and the container.

Figure 7:
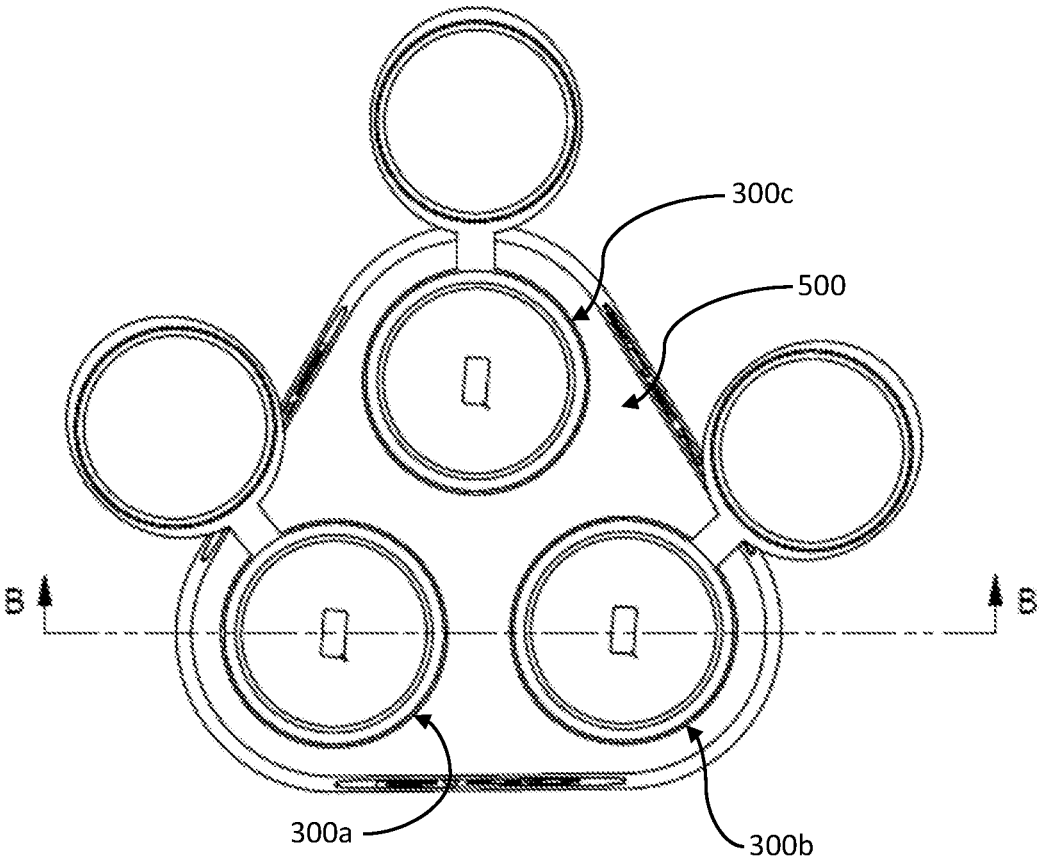
FIG. 7 is a top-down plan view of the embodiment of the new packaging system shown in FIG. 6.

It should be understood that a cross-section of the dome at the rim defines a shape of the dome. For example, a cross-section of the dome at the rim shown in FIG. 1 defines a circle. It should also be understood that the shape of the cross-section at the rim defines a dimension of the plug. That is, by taking the cross-section at the rim, both the shape of the dome and dimensions, such as, for the circular dome of FIG. 1, the diameter of the circle and the circumference of the circle may ber determined. Similarly, corresponding shape and dimensions of the opening of the container, for example the container of FIGS. 3-4, are obtainable by taking a cross-section of the container at the opening of the container. The shape of the opening is defined by the inner wall of the container at the opening, and the dimensions of the opening, such as, for the circular containers (see FIGS. 7-8), the opening shape of a circle with dimensions of diameter and circumference being defined by the inner wall are ascertainable by viewing the cross-section of the container at the opening. In the present system, the cross-section of the dome and the cross-section of the container opening have approximately the same shape (accounting for manufacturing tolerances), e.g. a circle, but they differ dimensionally. That is, the circular cross-section of the dome is greater in diameter than the cross-section of the container opening. That allows the dome to resiliently deform when inserted into the container and to frictionally engage the sidewall. As shown in FIG. 3 with reference to distance 310, by making the dome cross-section larger at the rim, a portion of the dome (see portion along distance 310) is deformed to engage the inner wall 302. Thus, the plug is adapted to fit within the container (as shown in FIG. 3, for example), and the plug may engage the inner wall (such as by friction) so that when the container is manipulated in space, such as by inverting the container, the plug remains within the container even when the top 304 is open.

The plug 100 is sized to fit snuggly within the cavity of the container. The dome 101 frictionally engages the interior surface 302 and resiliently deforms to press against the interior surface and thereby seal the interior cavity from the outside environment. The pull tab 104 is adapted to extend out of the container as shown by distance 309. Because the plug may be oriented at or near the opening of the container, it was found that the distance 309 may generally be between 20% and 50% the total length of the tab.

The shaft of the plug extends into the cavity. Preferably, the shaft extends far enough such that the distal end contacts a product, such as a cone, within the cavity when the product is resting on or being supported by (directly or indirectly) the bottom of the container. In that way, the plug is adapted to apply downward pressure on the product to essentially clamp the product between the bottom of the container and the distal end of the plug.

Figure 8:
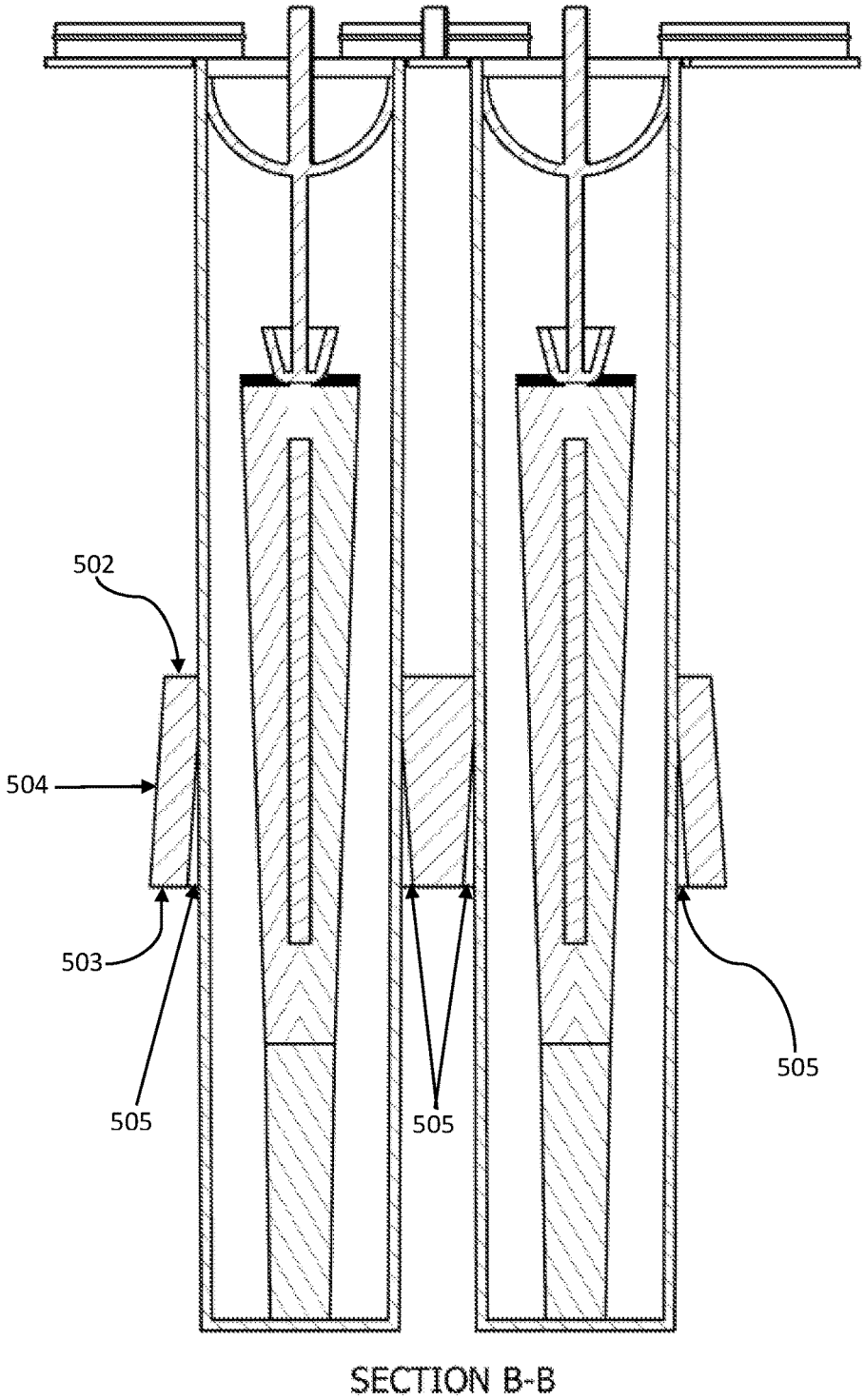
FIG. 8 is a cross-sectional view of an embodiment of the new packaging system.

As shown in FIG. 3, a cone may be the product. The cone may be formed of a paper substrate 401 forming a cone shape. A proximal end may include a mouthpiece or filter 402. The cone may contain particulate matter such as crumbled dried leaves (shown generally as wide-angled hash lines 403). Some embodiments may include a fluid core 404 disposed along, for example, a central axis of the cone. Opposite the proximal end is the distal end. The distal end may be folded or crimped to close off the interior of the cone. In one embodiment, as shown in FIG. 3, the paper of the distal end is folded in on itself (see generally 405) and held by plastic deformation within the interior of the cone so as to create a circumferential rim of paper 406. In the embodiment of FIG. 8, the distal end is closed such that the cone does not form a circumferential rim. The distal end may include an access hole 407. The access hole may be formed, for example, by piercing though the paper of the distal end, or by folding or crimping the paper of the distal end around a folding pin. The paper of the distal end extends in toward the center of the cone to substantially cover the particulate matter within the cone.

When the plug is inserted into the cavity, stopper 107 contacts the distal end of the product to apply pressure and generally hold it in place. Utilizing a larger stopper 107 provides a good contact surface between the plug and the product. The stopper may also be adapted to be similar in size to the access hole so as to form a plug in the access hole and substantially (or completely) close off the access hole.

The relatively thin shaft 106 of the plug and the resilient dome act as shock absorbers. When the container is jostled, the pressure applied by the plug keeps the plug engaged with the distal end, and helps prevent excessive lateral and vertical movement of the product in the cavity. When further force is applied against the plug by the product, such as from an impact to the container, the shaft will transfer some of that force into the dome which resiliently deflects inward to absorb some of the force. The thin shaft may also bend or flex to absorb the force. As the force abates, the resilient dome and shaft return to their original shape and thereby maintain pressure of the stopper against the product and prevent excessive movement of the product within the cavity.

In one embodiment, the plug frictionally engages the side wall of the cavity and therefore can be inserted and removed repeatedly. That allows easy access to the contents of the cavity.

In one embodiment, the diameter of the plug at the rim is between approximately 12 mm and 28 mm in diameter. The thickness of the dome at the rim is approximately 0.4 mm to 3.5 mm. The length of the tab 104 is between approximately 8 mm and 20 mm. The length of the shaft 106 (and for embodiments including a stopper, the length of the shaft and stopper together) is between approximately 12 mm and 30 mm and that the width of the shaft is between approximately 0.5 and 3 mm and the width of the stopper is between approximately 2 mm and 8 mm at its terminating surface. It was found that when utilizing a plug formed of molded silicone, the forgoing dimensional ranges of the plug would exhibit sufficient resiliency to form a fluid tight barrier between the cavity and the outside environment by frictional engagement, be easy enough to engage and disengage from the cavity without tools, and sufficiently flex to maintain contact and protect the integrity of the product while not damaging the product during insertion of the plug into the cavity.

The packaging system described herein contemplates the formation of multiple individually filled tubes that may be packaged together. To allow easy mix-and-match, the bundler 500 may be used to hold multiple containers. The bundler of FIG. 5 is one embodiment for holding three cylindrical tubes, but other designs could be utilize without departing from the utility of the system.

Figure 5:
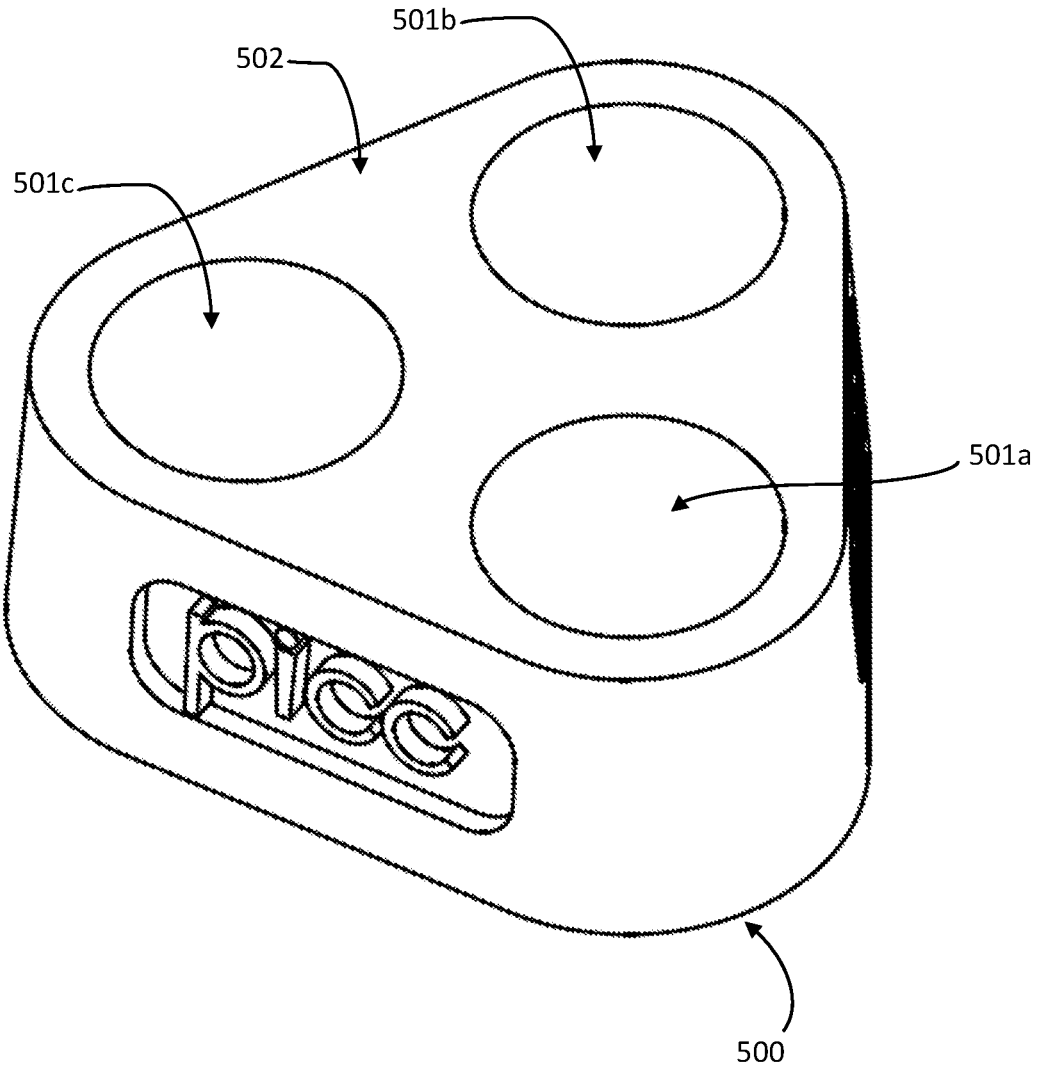
FIG. 5 is a perspective view of an embodiment of a bundling portion the new packaging system.
Figure 6:
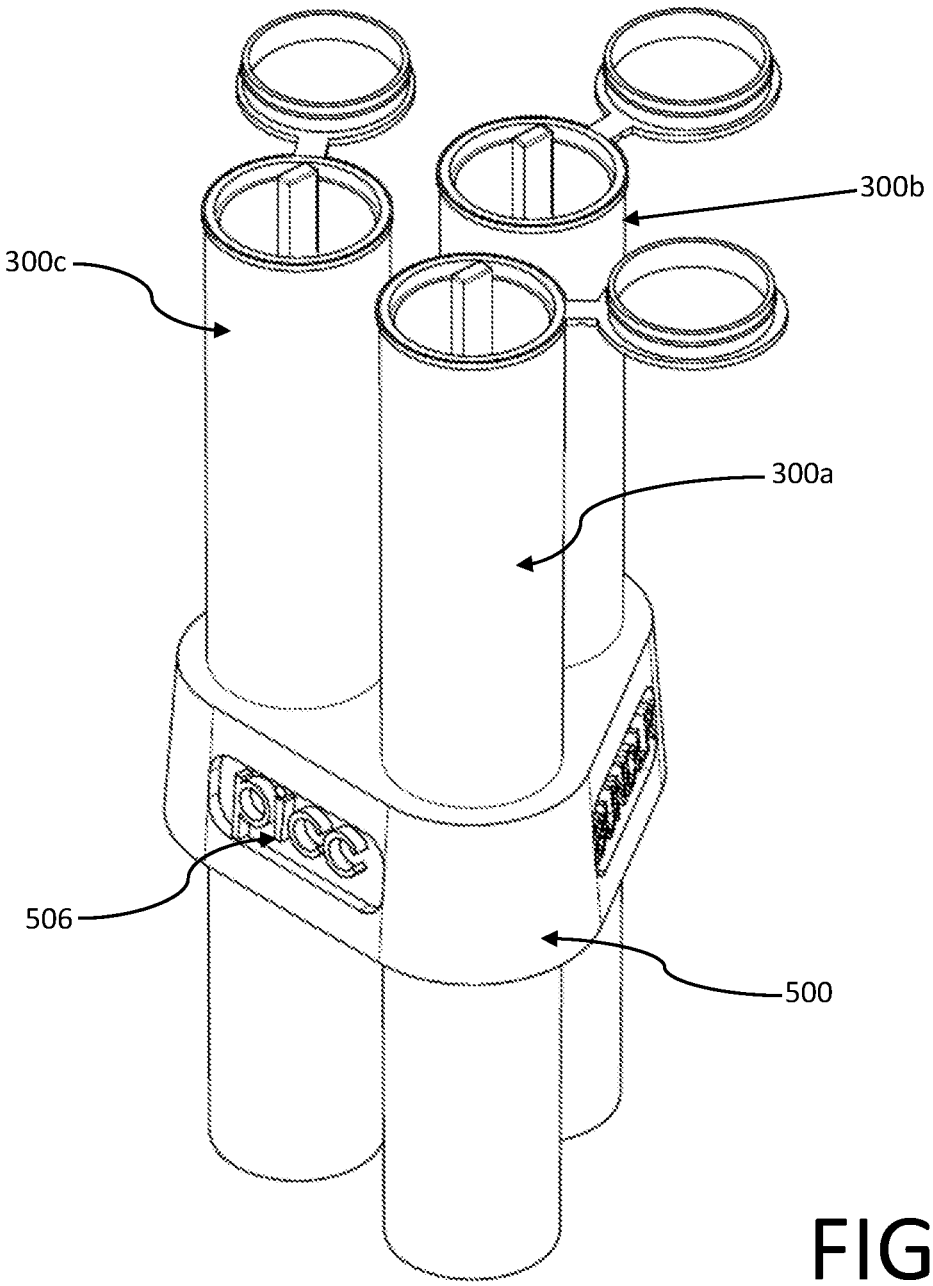
FIG. 6 is a perspective view of an embodiment of the new packaging system.

The embodiment of FIG. 5 includes a body 502 three holes 501*a*, 501*b*, 501*c* defined by interior walls within the body 502. While the body is shown as a triangle, any shape could be utilized, such as a square, circle, oval, hexagon, or the like without impacting the function of the bundler. The bundler may be formed of a resilient material, such as silicone or rubber. As shown in FIG. 6, containers 300*a*, 300*b*, 300*c* may be inserted into the holes and held by the bundler.

FIG. 8 is a cross-section showing the containers held by the bundler. The bundler has a top 502, bottom 503 and sides 504. The holes extend through the bundler from the top to the bottom and are bounded by circumferential interior walls of the bundler. In the embodiment of FIG. 8, the holes have a variable cross-sectional diameter along the length (from top to bottom of the bundler) of each hole. Thus, for embodiments with circular cross sections, the entirety of the hole exhibits the shape of a frustum with the narrow portion being at the top of the bundler and the wider base being at the bottom of the bundler. It was found that forming the holes with a diameter that was slightly smaller than the exterior diameter of the container allowed the bundler to frictionally engage the container. The smaller diameter is disposed along the top portion of the bundler, generally along between the top third and top quarter. That has been found to provide sufficient frictional engagement to hold the containers securely. The remaining portion of the hole flares out leaving a gap 505 between container and the interior wall of the bundler. Thus, as the container is slid into the hole, the bundler flexes out, reducing the friction between the interior wall of the hole and the container. However, when the container is withdrawn, the friction of the bundler interior wall against the container pulls the interior wall of the bundler inward, increasing the friction and making it more difficult to pull the container out than to insert the container into the bundler.

In one embodiment, the distance between the top of the bundler and the bottom of the bundler is approximately 0.5-1.5 inches. Not only does that provide the proper range of frictional engagement, but is also provides a surface for the formation of printed (including embossed or protruding) indicia 506.

Although the present invention has been described in terms of various embodiments, it is to be understood that such disclosure is not intended to be limiting. Various alterations and modifications will be readily apparent to those of skill in the art. Accordingly, it is intended that the appended claims be interpreted as covering all alterations and modifications as fall within the spirit and scope of the invention.

What is claimed is:

1. A packaging system comprising:

a hemispherical dome formed of a resilient material and having a smoothly curved convex surface;

a tab connected to the dome;

a shaft having a proximal end connected to the convex surface of the dome and distal end separated from the dome by a length of the shaft;

a container having an interior surface defining a cavity;

wherein the dome includes a smoothly curved concave surface opposite the convex surface;

wherein the tab is connected to the smoothly curved concave surface of the dome; and wherein the smoothly curved convex surface is frictionally engaged with the interior surface such that the dome is resiliently deformed.

2. The packaging system of claim 1, wherein the dome terminates at a rim and the tab has a length and a portion of the length of the tab extends beyond the rim and wherein the dome is positioned such that approximately 20% to 50% of the length of the tab extends beyond the cavity.

3. The packaging system of claim 2, further comprising: a top adapted to close the cavity.

4. The packaging system of claim 3, wherein the top includes a flange adapted to frictionally engage the interior surface of the container.

5. The packaging system of claim 3 wherein the top comprises a collar having a tapered portion adapted to contact the concave surface of the dome and thereby press convex surface of the dome against the interior surface of the container when the top is in a closed position.

6. A packaging system comprising:

a plug comprising:

a hemispherical dome having a smoothly curved convex surface and a smoothly curved concave surface opposite the convex surface and terminating at a rim, wherein the rim defines a cross-sectional shape of the dome;

a tab connected to the concave surface;

a shaft having a proximal end connected to the convex surface of the dome and distal end separated from the dome by a length of the shaft, wherein the dome, tab, and shaft are integrally formed together of the same resilient material;

a container having a vertically flat interior surface defining a cavity and at least one opening providing access to the cavity;

a cross-section of the container at the at least one opening defining an opening shape, the cross-sectional shape of the dome at the rim and the opening shape are the same shape, and the cross-sectional shape of the dome at the rim and the opening shape have differing dimensions such that the dimension of the cross-sectional shape of rim is greater than the dimension of the opening shape;

wherein the plug is adapted to fit within the cavity and engage the vertically flat interior surface of the container such that the engagement alone allows the plug to remain within the cavity regardless of the orientation of the container.

7. The packaging system of claim 6, wherein the opening shape and the cross-sectional shape of the dome are each circular and the circumference of the opening shape is less than the circumference of the cross-sectional shape of the dome.

8. The packaging system of claim 6, further comprising:

a product having a distal end and a proximal end disposed within the container such that the proximal end is supported by an interior surface of the container, wherein the plug is positioned within the cavity such that a) the dome engages the vertically flat interior surface, and b) the distal end of the shaft engages the distal end of the product.

9. The packaging system of claim 8, wherein the plug is formed such that, when the product applies a force on the plug, the dome of the plug resiliently deforms but the plug remains engaged with the distal end of the product throughout the application of the force and the plug allows movement of the product within the cavity while remaining engaged with product.

10. A packaging system comprising:

a plug comprising:

a dome having a convex surface and a concave surface opposite the convex surface and terminating at a rim, wherein the rim defines a cross-sectional shape of the dome;

a tab connected to the concave surface;

a shaft having a proximal end connected to the convex surface of the dome and distal end separated from the dome by a length of the shaft, wherein the dome, tab, and shaft are integrally formed together of the same resilient material;

a container having an interior surface defining a cavity and at least one opening providing access to the cavity;

wherein a cross-section of the container at the at least one opening defines an opening shape, the cross-sectional shape of the dome and the opening shape are the same shape, and the cross-sectional shape of the dome and the opening shape have differing dimensions;

wherein the plug is adapted to fit within the cavity and engage the interior surface of the container such that the engagement alone allows the plug to remain within the cavity regardless of the orientation of the container;

a product having a distal end and a proximal end disposed within the container such that the proximal end is supported by the interior surface of the container, wherein the plug is positioned within the cavity such that a) the dome engages the interior surface, and b) the distal end of the shaft engages the distal end of the product; and a bundler having a top and a bottom separated by a sidewall;

a plurality of interior walls, each defining a shape of a bundler cavity formed in the bundler that passes through the top and the bottom;

at least two of the bundler cavities having substantially the same shape;

the at least two bundler cavities being sized such that each is adapted to accommodate the container;

wherein the shape of the at least two bundler cavities is a frustum that is narrower at the top of the bundler than at the bottom of the bundler; and wherein the container is secured within one of the at least two bundler cavities by frictional engagement.

11. The packaging system of claim 10 wherein only the top third or less of a surface defining the bundler cavity in which the container is secured is in frictional engagement with the container.

* * * * *